United States Patent [19]

Lanati et al.

[11] Patent Number: 4,920,944

[45] Date of Patent: May 1, 1990

[54] IGNITION DEVICE FOR AN INTERNAL COMBUSTION ENGINE WITH TWO SPARK PLUGS PER CYLINDER

[75] Inventors: Paolo Lanati, Piacenza; Alessandro Piccone, Milan; Domenico D'Angelo, Monza, all of Italy

[73] Assignee: Alfa Lancia Industriale S.p.A., Arese, Italy

[21] Appl. No.: 361,282

[22] Filed: Jun. 5, 1989

[30] Foreign Application Priority Data

Jun. 9, 1988 [IT] Italy ..... 20914 A/88

[51] Int. Cl.[5] ..... F02P 15/08

[52] U.S. Cl. ..... 123/638; 123/625

[58] Field of Search ..... 123/625, 638, 640

[56] References Cited

U.S. PATENT DOCUMENTS

| | | | |
|---|---|---|---|
| 3,929,115 | 12/1975 | Yamauti et al. | 123/640 |
| 3,964,454 | 6/1976 | Nishimiya | 123/638 |
| 4,198,942 | 4/1980 | Kuroda et al. | 123/568 |
| 4,201,173 | 5/1980 | Okada et al. | 123/638 |
| 4,243,005 | 1/1981 | Hisatomi | 123/638 |
| 4,517,952 | 5/1985 | Hosoya | 123/625 |

FOREIGN PATENT DOCUMENTS

| | | | |
|---|---|---|---|
| 3128827 | 4/1982 | Fed. Rep. of Germany . | |
| 2102055 | 3/1972 | France . | |
| 52-6837 | 1/1977 | Japan | 123/638 |

OTHER PUBLICATIONS

Patent Abstracts of Japan, vol. 5, No. 139 (M-86) [811], Sep. 3, 1981; & JP-A-56-72260, Jun. 16, 1981.

*Primary Examiner*—Andrew M. Dolinar

*Attorney, Agent, or Firm*—Charles E. Brown; Charles A. Brown

[57] ABSTRACT

The device comprises a control center arranged to control a first and second ignition coil and to operate the engine under double ignition during normal use and under single ignition during full induction; in this latter case, ignition by the spark plugs of a first set is alternated with ignition by the spark plugs of a second set, for predetermined numbers of engine cycles.

4 Claims, 1 Drawing Sheet

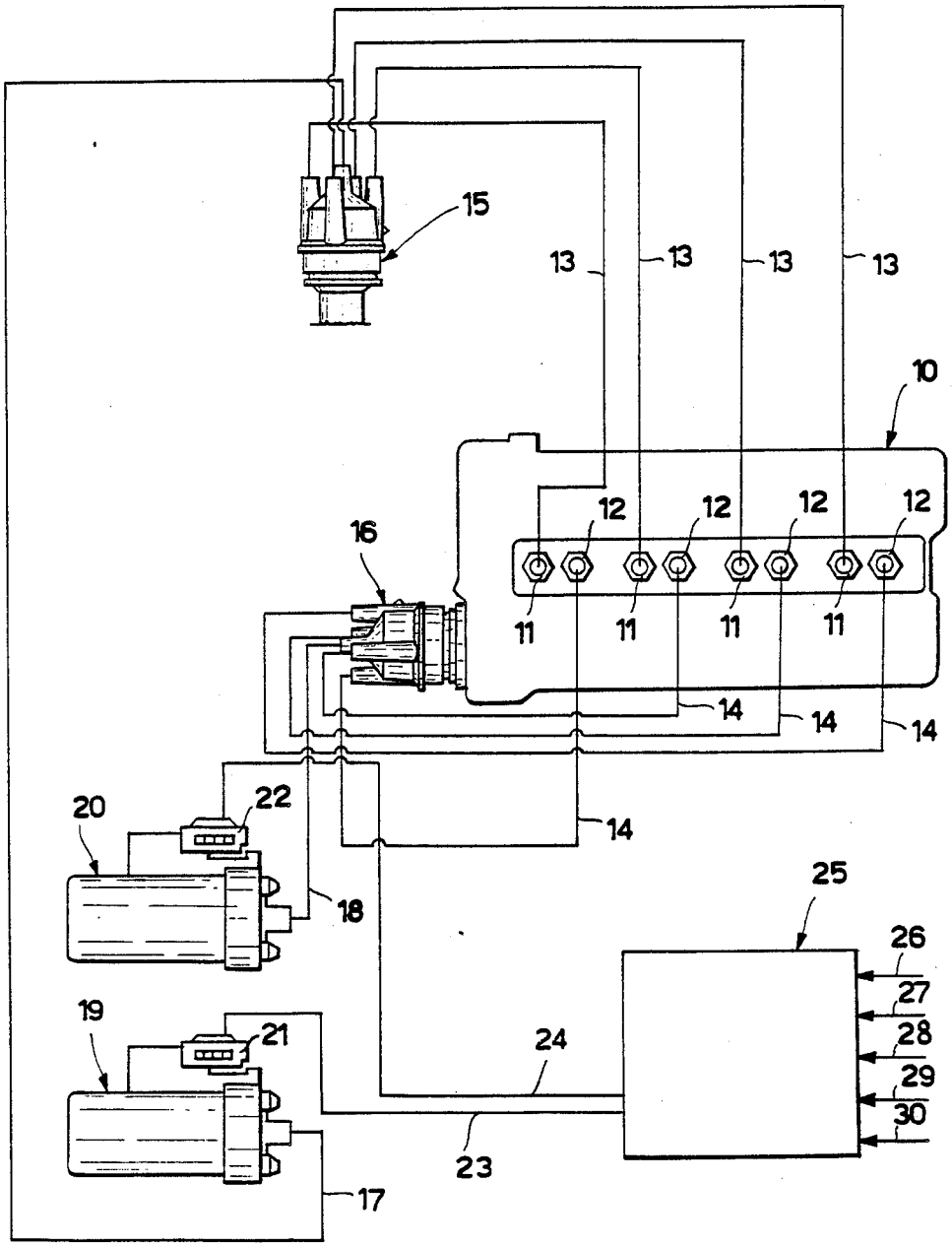
15
13
13
13
13
10
12
12
12
12
16
11
11
11
11
14
14
14
14
20
22
18
25
26
27
28
29
30
19
21
24
23
17

IGNITION DEVICE FOR AN INTERNAL COMBUSTION ENGINE WITH TWO SPARK PLUGS PER CYLINDER

This invention relates to an ignition device for double-ignition internal combustion engines, ie of the type comprising two spark plugs in each cylinder.

In internal combustion engines the tendency is to increasingly reduce the combustion duration time so that the indicated cycle is as close as possible to the Otto cycle, this being the cycle with the theoretically highest efficiency.

This is particularly so at low engine loads, at which combustion proceeds with difficulty both because of the low feed density due to throttling by the relative throttle valve or valves, and because of the presence of considerably quantities of gaseous combustion products which remain trapped in the cylinders at the end of the exhaust stage.

One of the most effective methods of increasing the combustion rate is to use double ignition, which at least as a first approximation enables this rate to be doubled.

This method also allows good-efficiency combustion of particularly weak mixtures or mixtures containing large quantities of gaseous combustion products, to the advantage of vehicle steerability and harmful gas emissions from the exhaust.

In contrast, at full induction, whether one or two points of ignition are used has hardly any influence on the power level attainable by an engine (provided that under all operating conditions the spark advance is optimised).

This is because the combustion rate is already considerable because of the high feed density and the high level of turbulence, and thus any differences which double ignition makes to the indicated cycle can be considered of negligible extend from the point of view of the overall area of the said cycle and consequently of the delivered power.

Indeed, when operating an engine under full induction, the double ignition system can lead to certain drawbacks because combustion develops so rapidly and violently that the engine can undergo strong vibration and produce a very high level sound emission.

In this respect, the particular pressure pattern means that frequencies around 1000–2000 Hz become the most important, and these are precisely the frequencies which are most perceptible to the human ear.

It has therefore been proposed to use devices able to allow ignition by both spark plugs of each cylinder only under determined engine operating conditions, for example during normal use, and to allow ignition by only one spark plug during other predetermined engine operating conditions such as under full induction, as in the device of U.S. Pat. No. 4,144,860.

These devices are however hardly satisfactory in practice because during single ignition operation one set of spark plugs is always inactive. These spark plugs can easily undergo soiling and thus encounter serious ignition difficulties when reactivated during double ignition operation.

The object of the present invention is therefore to provide a device which obviates these drawbacks by providing maximum operating reliability during both double and single ignition. The ignition device according to the invention for an internal combustion engine with two spark plugs per cylinder comprises a first and a second spark distributor, a first and a second ignition coil, first and second switch means, a control centre and sensors for prechosen engine parameters, a first set of spark plugs being operationally connected to said first spark distributor and to said first ignition coil, and a second set of spark plugs being operationally connected to said second spark distributor and to said second ignition coil, said first switch means being operationally connected to said first coil and to said control centre, and said second switch means being operationally connected to said second coil and to said control centre, said control centre being operationally connected to said sensors and comprising processor means arranged to feed spark plug activation control signals to said switch means in accordance with said engine parameters, the device being characterised in that said processor means are able to feed said control signals to said first and second switch means for predetermined values of determined engine parameters, and are able to feed said control signals alternately to said first and second switch means for other predetermined values of said determined engine parameters. With this device it is possible to operate the engine under double ignition during normal use and under single ignition during full induction. During this second condition, the one and the other of the two spark plugs of a cylinder are activated alternately so as to prevent soiling.

The device is therefore particularly advantageous in terms of reduction in fuel consumption and in pollutants in the exhaust gas, in addition to improvement in sound emission.

According to a preferred embodiment, the control centre can be programmed to activated one of the spark plugs for a determined number of engine cycles and the other of the spark plugs for another determined number of engine cycles, or preferably to activate the two spark plugs alternately for an equal number of engine cycles.

Characteristics and advantages of the invention are described hereinafter with reference to the accompanying FIGURE which shows a preferred embodiment of the invention by way of non-limiting example only.

In the FIGURE the reference numeral 10 diagrammatically indicates overall an internal combustion engine with four in-line cylinders. Each cylinder is provided with two spark plugs indicated by 11 and 12. The set of spark plugs 11 is connected by relative conductors 13 to a first spark distributor indicated overall by 15, and the set of spark plugs 12 is connected by respective conductors 14 to a second spark distributor indicated overall by 16.

The spark distributors are not shown in detail because they are of known type. Each comprises a rotor arm rotating at one half the speed of the crankshaft and connected by conductors 17 and 18 to the secondary winding of a respective ignition coil 19 and 20. As it rotates, the rotor arm distributes current from the secondary winding successively to the individual conductors 13 and 14 respectively, which are connected to the sets of spark plugs 11 and 12.

The primary and secondary windings of the coils 19 and 20 are connected to earth by modules 21 and 22 defining first and second switch means and comprising power transistors, not shown, which receive control signals from a control centre 25 through conductors 23, 24.

The signals emitted by the sensors of prechosen engine parameters such as engine load, r.p.m. and phase, position of throttle valve or valves, engine temperature etc. are fed to the control centre 25. These signals are represented by the arrows 26–30.

The control centre 25, which is preferably of the microprocessor type, calculates the spark advance as a function of the values of prechosen engine parameters and feeds control signals to the modules 21, 22 for igniting the sets of spark plugs 11 and 12. The control centre 25 is arranged to cause ignition by both spark plugs 11 and 12 of each cylinder under normal engine running conditions until predetermined load and r.p.m. values are reached, when double ignition is necessary to provide complete and rapid combustion of the feed mixture to the engine.

Under full induction conditions, ie above said predetermined load and r.p.m. values, the control centre 25 causes ignition by a single spark plug per cylinder, and specifically activates the set of spark plugs 11 for a certain number of engine cycles, and the set of spark plugs 12 for the same number of engine cycles alternately. This prevents the same spark plugs remaining inactive for prolonged periods of engine operation, with the risk of soiling and consequent ignition difficulties on reactivation.

The control centre 25 contains an algorithm designed to provide spark advance during the transient state of passage from double ignition operation to single ignition operation and vice versa, to prevent operational uncertainties.

We claim:

1. An ignition device for an internal combustion engine provided with two spark plugs (11 and 12) per cylinder, comprising a first and a second spark distributor (15 and 16), a first and a second ignition coil (19 and 20), first and second switch means (21 and 22), control centre (25) and sensors for prechosen engine parameters (26–30), a first set of spark plugs (11) being operationally connected to said first spark distributor (15) and to said first ignition coil (19), and a second set of spark plugs (12) being operationally connected to said second spark distributor (16) and to said second ignition coil (20), said first switch means (21) being operationally connected to said first coil (19) and to said control centre (25), and said second switch means (22) being operationally connected to said second coil (20) and to said control centre (25), said control centre (25) being operationally connected to said sensors (26–30) and comprising processor means arranged to feed to said switch means (21 and 22) control signals for the activation of said spark plugs (11 and 12) in accordance with said engine parameters, the device being characterised in that said processor means (25) are able to feed said control signals to said first and second switch means (21 and 22) for predetermined values of determined engine parameters, and are able to feed said control signals alternately to said first and second switch means (21, 22) for other predetermined values of said determined engine parameters.

2. A device as claimed in claim 1, characterised in that said processor means (25) are arranged to feed signals to said first switch means (21) for a determined number of engine cycles and to said second switch means (22) for a determined number of engine cycles.

3. A device as claimed in claim 1, characterised in that said processor means (25) are arranged to feed signals for an equal number of engine cycles alternately to said switch means (21, 22).

4. A device as claimed in claim 1, characterised in that said processor means (25) are arranged to feed signals for an equal number of engine cycles alternately to said switch means (21, 22).

* * * * *